US008426732B1

(12) United States Patent
Waldner

(10) Patent No.: US 8,426,732 B1
(45) Date of Patent: Apr. 23, 2013

(54) COMMUNICATION CABLE WITH IMPROVED MEMBER FOR POSITIONING SIGNAL CONDUCTORS

(75) Inventor: Timothy W. Waldner, Marietta, GA (US)

(73) Assignee: Superior Essex Communications LP, Atlanta, GA (US)

( * ) Notice: Subject to any disclaimer, the term of this patent is extended or adjusted under 35 U.S.C. 154(b) by 469 days.

(21) Appl. No.: 12/658,651

(22) Filed: Feb. 12, 2010

Related U.S. Application Data

(60) Provisional application No. 61/268,470, filed on Jun. 12, 2009.

(51) Int. Cl.
*H01B 7/00* (2006.01)

(52) U.S. Cl.
USPC ..... 174/110 R; 174/113 R; 174/113 C

(58) Field of Classification Search ..... 174/110 R, 174/113 R, 113 C, 120 R, 120 C, 131, 117 R, 174/117 F, 117 FF, 131 A, 127
See application file for complete search history.

(56) References Cited

U.S. PATENT DOCUMENTS

| | | | | |
|---|---|---|---|---|
| 2,538,019 | A * | 1/1951 | Lee | 156/54 |
| 5,952,615 | A * | 9/1999 | Prudhon | 174/113 C |
| 7,329,815 | B2 * | 2/2008 | Kenny et al. | 174/113 C |
| 7,834,271 | B2 * | 11/2010 | Gromko et al. | 174/113 R |
| 2003/0217863 | A1 * | 11/2003 | Clark et al. | 174/113 R |

FOREIGN PATENT DOCUMENTS

JP 2004-311120 A * 11/2004

* cited by examiner

*Primary Examiner* — William Mayo, III

(57) ABSTRACT

A communication cable can include twisted pairs of electrical conductors for transmitting electrical signals, such as for digital communication or data transmission. A flexible member within the cable can position the twisted pairs relative to one another to help the cable carry the electrical signals more effectively. The flexible member can have a cross section that is shaped like the letter T, the letter L, the letter J, or the letter Y. A jacket can circumferentially cover the positioned twisted pairs and the flexible member.

24 Claims, 8 Drawing Sheets

— 1-2 — 1-3 — 1-4 — 2-3
— 2-4 — 3-4 — Lower limit

| Pair | Worst case | Value | Freq. |
|---|---|---|---|
| 1-2 | 9.2 | 57.7 | 82.9 |
| 1-3 | 8.6 | 87.4 | 0.8 |
| 1-4 | 8.9 | 87.6 | 0.8 |
| 2-3 | 10.5 | 59.6 | 75.4 |
| 2-4 | 7.3 | 43.2 | 366.2 |
| 3-4 | 8.6 | 44.7 | 352.5 |

1010 1015 1020

1000

— 1-2 — 1-3 — 1-4 — 2-3
— 2-4 — 3-4 — Lower limit

| Pair | Worst case | Value | Freq. |
|---|---|---|---|
| 1-2 REV | 7.4 | 54.4 | 104.7 |
| 1-3 REV | 9.8 | 84.8 | 1.4 |
| 1-4 REV | 9.7 | 88.4 | 0.8 |
| 2-3 REV | 8.5 | 44.2 | 373.0 |
| 2-4 REV | 9.9 | 46.2 | 340.3 |
| 3-4 REV | 6.2 | 47.9 | 238.2 |

1010 1015 1020

1100

| Pair | Worst case | Value | Freq. |
|---|---|---|---|
| 1 | 6.8 | 83.1 | 0.9 |
| 2 | 7.6 | 60.7 | 30.3 |
| 3 | 9.1 | 52.3 | 139.2 |
| 4 | 7.6 | 48.0 | 212.1 |

1210 1215 1220

1200

| Pair | Worst case | Value | Freq. |
|---|---|---|---|
| 1 REV | 8.1 | 85.1 | 0.8 |
| 2 REV | 7.4 | 41.2 | 369.8 |
| 3 REV | 7.9 | 47.6 | 236.7 |
| 4 REV | 6.9 | 46.6 | 236.7 |

1210 1215 1220

1300

COMMUNICATION CABLE WITH IMPROVED MEMBER FOR POSITIONING SIGNAL CONDUCTORS

CROSS REFERENCE TO RELATED APPLICATIONS

This application claims priority to U.S. Provisional Patent Application No. 61/268,470, filed on Jun. 12, 2009 in the name of Timothy Waldner and entitled "Twisted Pair Cable Comprising Improved Pair Separator," the entire contents of which are hereby incorporated herein by reference.

FIELD OF THE TECHNOLOGY

The present invention relates to communication cables comprising multiple electrical conductors for transmitting communication signals, and more specifically to cables in which a flexible member positions twisted pairs of insulated electrical conductors relative to one another to enhance signal performance, wherein the cross section of the flexible member can have a beneficial shape, for example resembling the letter T, the letter L, or the letter Y.

BACKGROUND

As the desire for enhanced communication bandwidth escalates, transmission media are pressed to convey information at higher speeds while maintaining signal fidelity and avoiding crosstalk. For example, a single communication cable may be called upon to transmit multiple communication signals over respective electrical conductors concurrently. Such a communication cable may have two or more twisted pairs of insulated electrical conductors ("twisted pairs") that are separated by a conventional element disposed in the core of the communication cable. The conventional element attempts to maintain some level of relative positioning of the twisted pairs within the cable for addressing crosstalk, which has posed perennial design challenges for high-performance 4-pair data cables. In many circumstances, movement of twisted pairs relative to one another within conventional communication cables can lead to decreased signal performance. For example, when a conventional cable is installed, external and internal forces may reorient the twisted pairs within the cable to positions at which crosstalk may escalate and signal quality may diminish.

Accordingly, what is needed is an improved capability for orienting signal conductors, electrical conductors, and/or twisted pairs within a communication cable. A need exists for a technology that can improve placement of electrical conductors within a communication cable. A need also exists for a capability to maintain relative positions of electrical conductors within a communication cable while the cable is deployed, installed, or otherwise moved, twisted, bent, and or unrolled. A further need exists for a pair positioning member that can be readily anchored within a communication cable to facilitate robust positioning. A need further exists for a pair positioning member having reduced material relative to conventional technology, to facilitate lower manufacturing and material costs, lighter weight cables, and less material to generate flames or smoke during burn tests. A capability addressing one or more such needs or some other related deficiency in the art would enhance bandwidth that a communication cable can carry reliably.

SUMMARY

The present invention supports positioning electrical conductors within a communication cable to facilitate enhanced signal performance.

In one aspect of the present invention, a communication cable can comprise electrical conductors for transmitting communication signals. For example, the communication cable can comprise twisted pairs of insulated electrical conductors that extend lengthwise along the cable. A flexible member within an interior region of the cable can position the twisted pairs relative to one another to help the cable transmit the communication signals more effectively, for example controlling crosstalk. In cross section, the flexible member can have a T-shape, a Y-shape, or an L-shape. Alternatively (or additionally), the flexible member can comprise two strips of material, a first strip running along or against an interior surface of a cable jacket, and a second strip that comprises one edge joined to the first strip and an opposite edge forming a point or a tip opposite the first strip.

The discussion of positioning conductors within a communication cable presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1:
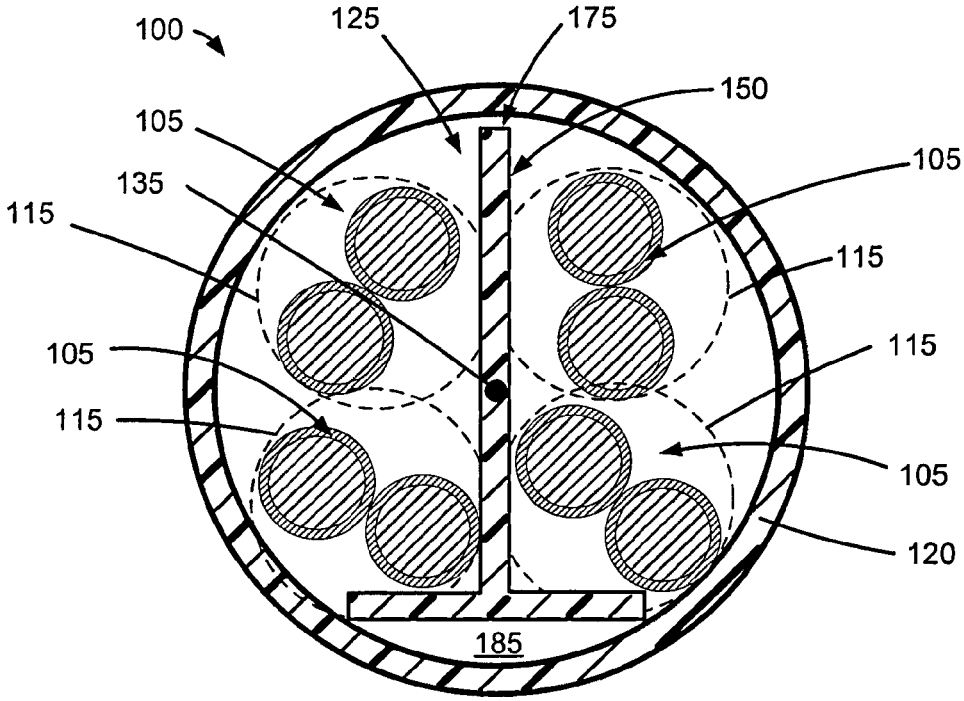
FIG. 1 is a cross sectional view of an exemplary communication cable that comprises a flexible member having a T-shape and positioning twisted pairs in accordance with certain embodiments of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

Technology for robustly positioning or orienting signal conductors, such as twisted pairs of individually insulated electrical conductors, will now be described more fully with reference to FIGS. 1-13, which describe representative embodiments of the present invention. FIGS. 1 and 8 provide cross sectional views describing exemplary communication cables. FIGS. 2, 3, 4, 5, 6, 7, and 9 describe exemplary flexible members for twisted pair positioning in communication cables. FIGS. 10, 11, 12, and 13 provide laboratory test results of electrical signal performance for communication cables.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting and among others supported by representations of the present invention.

Turning now to FIG. 1, this figure illustrates a cross section of an exemplary communication cable 100 that comprises a flexible member 150 having a T-shape and positioning twisted pairs 105 according to certain exemplary embodiments of the present invention.

A jacket 120 typically having a polymer-based composition seals the communication cable 100 from the environment and provides strength and structural support. In an exemplary embodiment, the jacket 120 has an outer diameter of about 0.205 inches and a wall thickness of about 0.016 inches. In various embodiments, the jacket 120 comprises polymeric material, polyvinyl chloride ("PVC"), polyurethane, one or more polymers, a fluoropolymer, polyethylene, neoprene, cholorosulphonated polyethylene, fluorinated ethylene propylene ("FEP"), flame retardant PVC, low temperature oil resistant PVC, polyolefin, flame retardant polyurethane, flexible PVC, or some other appropriate material known in the art, or a combination thereof, for example. In certain exemplary embodiments, the jacket 120 can comprise flame retardant and/or smoke suppressant materials.

The jacket 120 can be single layer or have multiple layers. In certain exemplary embodiments, a tube or tape (not illustrated) can be disposed between the jacket 120 and the twisted pairs 105. Such a tube or tape can be made of polymeric or dielectric material, for example. In various embodiments, the jacket 120 can be characterized as an outer jacket, an outer sheath, a casing, a circumferential cover, or a shell.

The communication cable 100 can comprise shielding or may be unshielded, as FIG. 1 illustrates. In certain exemplary embodiments, a metallic foil or other electrically conductive material can cover the twisted pairs 105 and/or the cable core 125 to provide shielding. In certain exemplary embodiments, the communication cable 100 can be shielded with a system of electrically isolated patches of shielding material, for example as described in U.S. patent application Ser. No. 12/313,914, entitled "Communication Cable Comprising Electrically Isolated Patches of Shielding Material," the entire contents of which are hereby incorporated herein by reference.

A metallic material, whether continuous or comprising electrically conductive patches, can be disposed on a substrate, such as a tape placed between the twisted pairs 105 and the jacket 120, or adhered to the jacket 120. In certain embodiments, the jacket 120 comprises conductive material and may be or function as a shield. In certain embodiments, the jacket 120 comprises armor, or the communication cable 100 comprises a separate, outer armor for providing mechanical protection. In the illustrated embodiment, the cable core 125 of the communication cable 100 contains four twisted pairs 105, four being an exemplary rather than limiting number. Other exemplary embodiments may have fewer or more twisted pairs 105.

Each twisted pair 105 can carry data or some other form of information, for example in a range of about one to ten Giga bits per second ("Gbps") or another appropriate speed, whether faster or slower. In certain exemplary embodiments, each twisted pair 105 supports data transmission substantially higher than ten Gbps. Accordingly, the illustrated communication cable 100 can convey four distinct channels of information simultaneously. In certain exemplary embodiments, the metallic conductor diameter of each twisted pair 105 can be in a range of about 0.0223 inches to about 0.0227 inches, while the outer, insulation diameter can be in a range of about 0.0385 inches to about 0.0395 inches, for example.

The cable core 125 can be filled with a gas such as air (as illustrated) or alternatively a gelatinous, solid, powder, moisture absorbing material, water-swellable substance, dry filling compound, or foam material, for example in interstitial spaces between the twisted pairs 105. Other elements can be added to the cable core 125, for example one or more optical fibers, additional electrical conductors, additional twisted pairs, or strength members, depending upon application goals.

In certain exemplary embodiments, the twisted pairs 105 have different twist rates (twists-per-meter or twists-per-foot) and/or different twist directions (clockwise verses counterclockwise). Alternatively, the twisted pairs 105 can have common twist rates and common twist directions. In certain exemplary embodiments, the twist rate of a single twisted pair 105 varies longitudinally. In the illustrated view, each twisted pair 105 sweeps out a twist path 115 as it twists/rotates, with the twist paths 115 generally circular when viewed end-on as illustrated. (The twist paths 115 are illustrated in approximation.)

As will be discussed in further detail below, the flexible member 150 maintains a desired orientation of the twisted pairs 105 to provide beneficial signal performance. The twist path 115 of each twisted pair 105 typically adjoins the flexible member 150 substantially continuously or at interrupted or intermittent longitudinal locations along the communication cable 100. Those of ordinary skill in the art will appreciate that the twisted pairs 105 can undergo physical distortion during cabling and thus may overlap or impinge on other elements in an illustration. The flexible member 150 improves electrical performance of the communication cable 100 via controlling the relative positions and distances of separation among the twisted pairs 105. The improved electrical performance can include reduced crosstalk as will be discussed in further detail below.

In certain exemplary embodiments, the differences between twist rates of twisted pairs 105 that are circumferentially adjacent one another are greater than the differences between twist rates of twisted pairs 105 that are diagonal from one another. As a result of having similar twist rates, the twisted pairs 105 that are diagonally disposed can be more susceptible to crosstalk issues than the twisted pairs 105 that are circumferentially adjacent. In such embodiments, the flexible member 150 can orient the twisted pairs 105 that are diagonal from one another for precise separation to achieve enhanced crosstalk performance.

Figure 2:
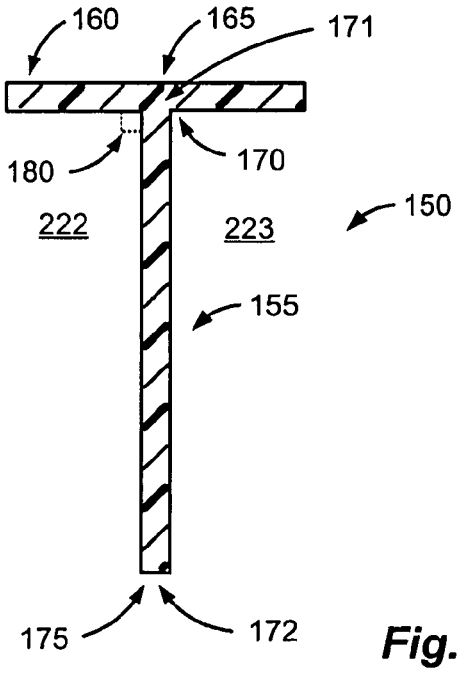
FIG. 2 is a cross sectional view of an exemplary flexible member having a T-shape for positioning twisted pairs within a communication cable in accordance with certain embodiments of the present invention.

FIG. 2 illustrates a cross section of a flexible member 150 having a T-shape for positioning twisted pairs 105 within a communication cable 100 according to certain exemplary embodiments of the present invention. FIG. 2 describes an exemplary embodiment of the flexible member 150 illustrated in FIG. 1 and discussed above and will be discussed in such an exemplary context.

Referring now to FIGS. 1 and 2, the flexible member 150 comprises a strip 160 running lengthwise (or longitudinally) along an interior or inner surface of the jacket 120. In an exemplary embodiment, the strip 160 has a length of about 50 mils (thousands of an inch) and a thickness of about 10 mils. In the illustrated exemplary embodiment, the strip 160 can be characterized as a ribbon of material or as a fin (or as two fins). The strip 160 typically moves helically around the inner surface of the jacket 120 along the longitudinal length of the jacket 120. This helical configuration is due to twist of the cable core 125 along the longitudinal axis 135 of the communication cable 100. That is, the strip 160 corkscrews about the cable core 125 as a result of cable lay.

Figure 5:
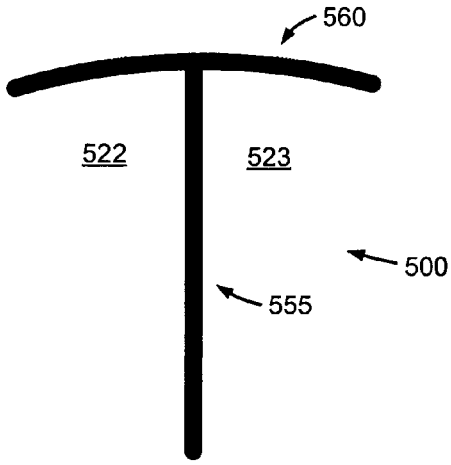
FIG. 5 is a diagram illustrating an exemplary cross sectional form of a flexible member having a T-shape for positioning twisted pairs within a communication cable in accordance with certain embodiments of the present invention.

The strip 160 can, but not necessarily does, contact the jacket 120. In certain exemplary embodiments, a gap 185 separates at least part of the strip 160 from the jacket 120. As shown in FIG. 5 and discussed below, in certain exemplary embodiments, the strip 160 deforms or conforms to the interior surface and/or contours of the jacket 120, thus reducing or substantially eliminating the gap 185.

The strip 160 is substantially constrained on an inner side by the twisted pairs 105 and on an exterior side by the jacket 120. Accordingly, the strip 160 anchors the flexible member 150 to facilitate robust pair positioning.

In addition to the strip 160, the flexible member 150 comprises the strip 155 projecting from the strip 160. In an exemplary embodiment, the strip 155 has a thickness of about 10 mils and protrudes from the strip 160 about 160 mils. In the illustrated embodiment, the strip 155 can be characterized as a ribbon of material or as a fin. The edge 171 of the strip 155 joins to the strip 160 at an approximate midpoint 165 of the strip 160. (See FIG. 3 for an embodiment in which the joint 170 is displaced from the midpoint.)

The joint 170 between the strips 155 and 160 is typically seamless as a result of fabricating the flexible member 150 via extrusion through a die having a T-shaped orifice. However, in certain exemplary embodiments, the joint 170 can be formed using plastic welding, fusing, adhesives, bonding, or another appropriate fabrication technique. Accordingly, the flexible member 150 can be formed as one unitary piece of material or assembled from multiple components.

In certain exemplary embodiments, the strips 155 and 160 form a substantially perpendicular angle 180 at the joint 170. Alternatively, the strips 155 and 160 may be joined to form other angles, for example that are acute or obtuse.

In the illustrated embodiment, the strip 155 runs along the longitudinal axis 135 of the communication cable 100, substantially dividing or bisecting the interior of the communication cable 100. Two of the four twisted pairs 105 are disposed in an interior space 222 formed on one side of the strip 155, while the other two of the four twisted pairs 105 are disposed in an interior space 223 on the opposite side of the strip 155.

In the illustrated embodiment, the edge 172 of the strip 155, which is opposite the edge 171, forms a point or a tip 175. The term "tip," as used herein in this context, generally refers to an end or terminating area of a projecting object or feature. In various embodiments, the tip 175 can be rounded, square, sharp, dull, curved, angled, bent, or have some other appropriate geometric form or shape.

In certain exemplary embodiments, the tip 175 extends substantially to the interior surface of the jacket 120. In certain exemplary embodiments, the tip 175 contacts or adjoins the jacket 120. In certain exemplary embodiments, the tip 175 protrudes into and/or slightly deforms the jacket 120. Such deformation may be confined to an interior surface of the jacket 120. Alternatively, an exterior surface of the jacket 120 can have a slight ridge due to contact between the tip 175 and the jacket 120 during extrusion of the jacket over the cable core 125. In certain exemplary embodiments, contact with or protrusion into the jacket 120 can provide structural support for the cable core 125, enhancing robustness of pair positioning.

In certain exemplary embodiments, the tip 175 is disposed between the longitudinal axis 135 of the communication cable 100 and the interior surface of the jacket 120. For example, the tip 175 can be disposed about halfway between the longitudinal axis 135 and the interior surface of the jacket 120, with the strip 155 projecting beyond the longitudinal axis 135.

The strips 155 and 160 typically have common material compositions. However, in certain exemplary embodiments, compositions of the strips 155 and 160 differ from one another, for example as a result of having either different additives or differing base compositions.

In various exemplary embodiments, the strip 155 can comprise polypropylene, PVC, polyethylene, FEP, ethylene chlorotrifluoroethlyene ("ECTFE"), or some other suitable polymeric or dielectric material, for example. The strip 155 can be filled, unfilled, foamed, un-foamed, homogeneous, or inhomogeneous and may or may not comprise additives. The strip 155 can comprise flame retardant and/or smoke suppressant materials. In certain exemplary embodiments, the strip 155 is crosslinked. The strip 155 can be extruded, pultruded, or formed in another appropriate process known in the art.

In various exemplary embodiments, the strip 160 can comprise polypropylene, PVC, polyethylene, FEP, ethylene ECTFE, or some other suitable polymeric or dielectric material, for example. The strip 160 can be filled, unfilled, foamed, un-foamed, homogeneous, or inhomogeneous and may or may not comprise additives. The strip 160 can comprise flame retardant and/or smoke suppressant materials. In certain exemplary embodiments, the strip 160 is crosslinked. The strip 160 can be extruded, pultruded, or formed in another appropriate process known in the art.

In various exemplary embodiments, the strip 155 and the strip 160 can jointly comprise polypropylene, PVC, polyethylene, FEP, ethylene ECTFE, or some other suitable polymeric or dielectric material, for example. The strip 155 and the strip 160 can jointly be filled, unfilled, homogeneous, or inhomogeneous and may or may not comprise additives. The strip 155 and the strip 160 can jointly comprise flame retardant and/or smoke suppressant materials. In certain exemplary embodiments, the strip 155 and the strip 160 are jointly crosslinked. The strip 155 and the strip 160 can be jointly extruded, pultruded, or formed in another appropriate process known in the art.

Accordingly, the flexible member 150 can have a substantially uniform composition, can be made of a wide range of materials, and/or can be fabricated in a single manufacturing pass. Further, the flexible member 150 can be foamed, can be a composite, and can include one or more strength members, fibers, threads, or yarns. Additionally, the flexible member 150 can be hollow to provide a cavity that may be filled with air or some other gas, gel, fluid, moisture absorbent, water-swellable substance, dry filling compound, powder, an optical fiber, a metallic conductor, shielding, or some other appropriate material or element.

The flexible member 150, as with other embodiments described herein, supports manufacturing cost savings. For example, the form of the flexible member 150 can have less material than conventional technologies and thus lower material costs.

In certain exemplary embodiments, the flexible member 150 can comprise electrically conductive patches that are electrically isolated from one another to provide one or more shields. Such patches can adhere to a surface of the flexible member 150, for example.

The form of the cross section of the flexible member illustrated in FIGS. 1 and 2 is one example of a T-shape. FIGS. 3, 4, 5, and 6 provide other, non-limiting examples of cross sectional forms that have a T-shape.

Figure 3:
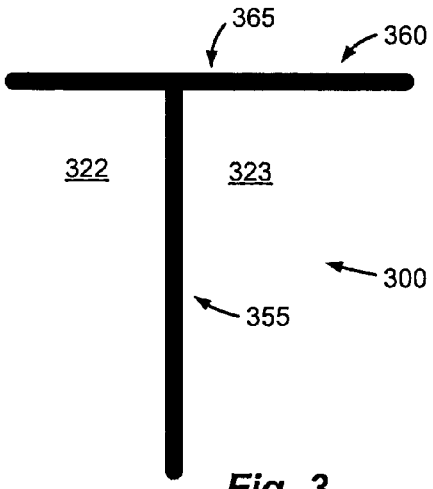
FIG. 3 is a diagram illustrating an exemplary cross sectional form of a flexible member having a T-shape for positioning twisted pairs within a communication cable in accordance with certain embodiments of the present invention.

Referring to FIG. 3, this figure illustrates a cross sectional form of a flexible member 300 having a T-shape for positioning twisted pairs 105 within a communication cable 100 according to certain exemplary embodiments of the present invention. In an exemplary embodiment, the flexible member 300 of FIG. 3 can be disposed in the communication cable 100 of FIG. 1, for example as a substitute for the flexible member 150 that FIGS. 1 and 2 illustrate. Thus, the flexible member 300 can provide two chambers 322, 323 (or interior spaces), each holding two twisted pairs 105.

The flexible member 300 comprises the section 360 joined with the section 355. In various embodiments, the section 360 can be characterized as a fin, two fins, a ribbon, a narrow strip of material, or two projections. In various embodiments, the section 355 can be characterized as a fin, a ribbon, a narrow strip of material, or a projection. In the illustrated example, the sections 355 and 360 join at a location that is offset from the midpoint 365 of the section 360.

Figure 4:
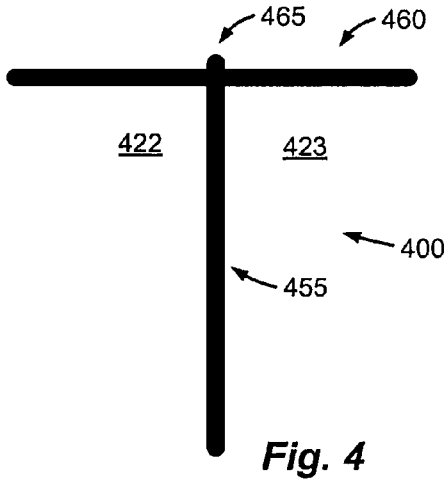
FIG. 4 is a diagram illustrating an exemplary cross sectional form of a flexible member having a T-shape for positioning twisted pairs within a communication cable in accordance with certain embodiments of the present invention.

Referring to FIG. 4, this figure illustrates a cross sectional form of a flexible member 400 having a T-shape for positioning twisted pairs 105 within a communication cable 100 according to certain exemplary embodiments of the present invention. In an exemplary embodiment, the flexible member 400 of FIG. 4 can be disposed in the communication cable 100 of FIG. 1, for example as a substitute for the flexible member 150 that FIGS. 1 and 2 illustrate. Thus, the flexible member 400 can provide two chambers 422, 423 (or interior spaces), each holding two twisted pairs 105.

The flexible member 400 comprises the section 460 joined with the section 455. In various embodiments, the section 460 can be characterized as a fin, two fins, a ribbon, a narrow strip of material, or two projections. In various embodiments, the section 455 can be characterized as a fin, a ribbon, a narrow strip of material, or a projection. In the illustrated example, a nub 465 protrudes from the section 460 opposite the section 455.

Referring to FIG. 5, this figure illustrates a cross sectional form of a flexible member 500 having a T-shape for positioning twisted pairs 105 within a communication cable 100 according to certain exemplary embodiments of the present invention. In an exemplary embodiment, the flexible member 500 of FIG. 5 can be disposed in the communication cable 100 of FIG. 1, for example as a substitute for the flexible member 150 that FIGS. 1 and 2 illustrate. Thus, the flexible member 500 can provide two chambers 522, 523 (or interior spaces), each holding two twisted pairs 105.

The flexible member 500 comprises the section 560 joined with the section 555. In various embodiments, the section 560 can be characterized as a fin, two fins, a ribbon, a narrow strip of material, or two projections. In various embodiments, the section 555 can be characterized as a fin, a ribbon, a narrow strip of material, or a projection. In the illustrated example, the section 560 bows outward or is convex (from a perspective outside the cable). In certain embodiments, the section 560 bows with substantially the same radius of curvature as the inner surface of jacket 120 (see FIG. 1). Accordingly, the section 560 can conform to the contour or shape of the jacket 120. In certain exemplary embodiments, one, two, or more nubs (not depicted in FIG. 5 but illustrated in FIG. 4) protrude from the section 560.

Figure 6:
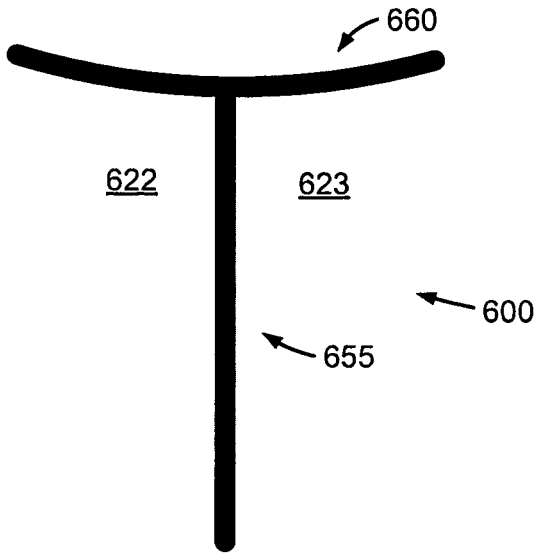
FIG. 6 is a diagram illustrating an exemplary cross sectional form of a flexible member having a T-shape for positioning twisted pairs within a communication cable in accordance with certain embodiments of the present invention.

Referring to FIG. 6, this figure illustrates a cross sectional form of a flexible member 600 having a T-shape for positioning twisted pairs 105 within a communication cable 100 according to certain exemplary embodiments of the present invention. In an exemplary embodiment, the flexible member 600 of FIG. 6 can be disposed in the communication cable 100 of FIG. 1, for example as a substitute for the flexible member 150 that FIGS. 1 and 2 illustrate. Thus, the flexible member 600 can provide two chambers 622, 623 (or interior spaces), each holding two twisted pairs 105.

The flexible member 600 comprises the section 660 joined with the section 655. In various embodiments, the section 660 can be characterized as a fin, two fins, a ribbon, a narrow strip of material, or two projections. In various embodiments, the section 655 can be characterized as a fin, a ribbon, a narrow strip of material, or a projection. In the illustrated example, the section 660 bows inward or is concave (from a perspective outside the cable). In certain embodiments, the section 660 bows to facilitate a gap 185 between the jacket 120 and the section 660 (see the gap 185 that FIG. 1 illustrates).

Figure 7:
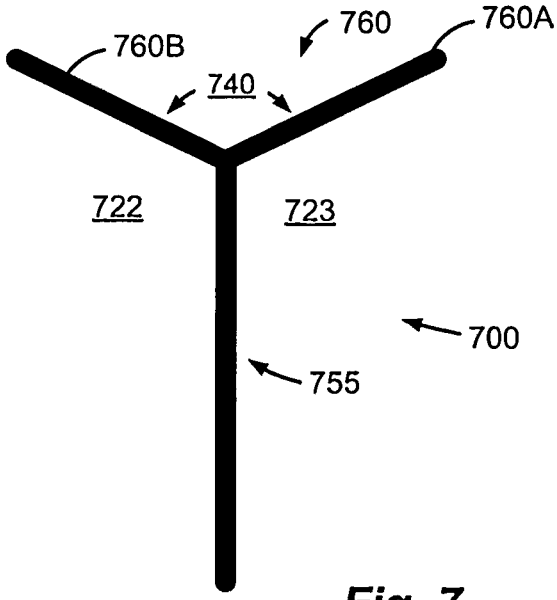
FIG. 7 is a diagram illustrating an exemplary cross sectional form of a flexible member having a Y-shape for positioning twisted pairs within a communication cable in accordance with certain embodiments of the present invention.
Figure 8:
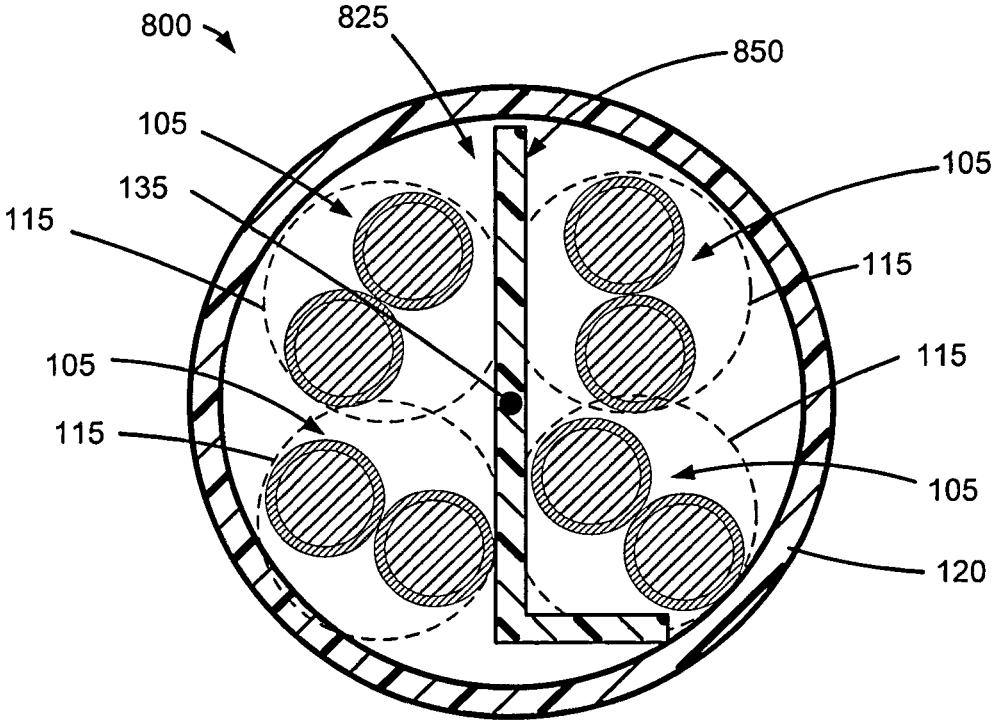
FIG. 8 is a cross sectional view of an exemplary communication cable that comprises a flexible member having an L-shape, or alternatively having a J-shape, and positioning twisted pairs in accordance with certain embodiments of the present invention.

Referring to FIG. 7, this figure illustrates a cross sectional form of a flexible member 700 having a Y-shape for positioning twisted pairs 105 within a communication cable 100 according to certain exemplary embodiments of the present invention. In an exemplary embodiment, the flexible member 700 of FIG. 7 can be disposed in the communication cable 100 of FIG. 1, for example as a substitute for the flexible member 150 that FIGS. 1 and 2 illustrate. Thus, the flexible member 700 can provide two chambers 722, 723 (or interior spaces), each holding two twisted pairs 105.

The flexible member 700 comprises the section 760 joined with the section 755. In various embodiments, the section 755 can be characterized as a fin, a ribbon, a narrow strip of material, or a projection. In various embodiments, the section 760 can be characterized as a fin, two fins, a ribbon, a narrow strip of material, or two projections.

The section 760 comprises the section 760A and the section 760B joined at an angle 740, typically but not necessarily less than 180 degrees, opposite the section 755. In certain embodiments, the angle 740 can be between about 90 and about 180 degrees. The angle 740 and form of the section 755 typically provides a gap 185 between the jacket 120 and the section 755 (see FIG. 1). In many embodiments, the section 760 will flatten upon deployment in the communication cable 100. Thus, the angle 740 can increase when the flexible member 700 is in use. Further the flexible member 700 can deform to resemble the embodiment of FIG. 5, discussed above. Accordingly, the embodiment illustrated in FIG. 7 can be viewed as either having a T-shape or having a Y-shape.

The flexible-member and cable embodiments illustrated in FIGS. 1 through 7 and discussed above provide non-limiting examples of geometric forms and configurations supported by exemplary embodiments of the present invention. Other embodiments may have different forms that may deviate substantially from the illustrated and/or described shapes. For example, FIGS. 8 and 9 illustrate flexible member embodiments that resemble the letter L, as will be discussed below.

Figure 9:
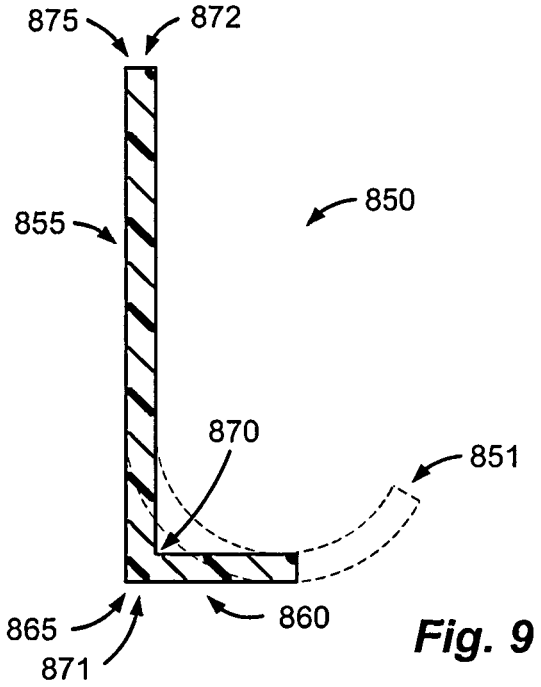
FIG. 9 is a cross sectional view of an exemplary flexible member having an L-shape for positioning twisted pairs within a communication cable in accordance with certain embodiments of the present invention.

Turning now to FIGS. 8 and 9, FIG. 8 illustrates a cross section of a communication cable 800 that comprises a flexible member 850 having an L-shape, or alternatively having a J-shape, and positioning twisted pairs 105 according to certain exemplary embodiments of the present invention. FIG. 9 illustrates a cross sectional view of a flexible member 850 having an L-shape for positioning twisted pairs 105 within a communication cable 800 according to certain exemplary embodiments of the present invention. In an exemplary embodiment, the flexible member 850 that FIG. 9 illustrates can be the flexible member 850 illustrated in FIG. 8 and will be discussed in such a context, without limitation. In addition to the flexible member 850 that is L-shaped, FIG. 9 illustrates the flexible member 851 (drawn superimposed) that has a J-shape, as an alternative form.

The communication cable 800 comprises a jacket 120 circumferentially covering a cable core 825. The cable core 825 comprises four twisted pairs 105, each exhibiting a twist path 115, and a flexible member 850. The flexible member 850 positions the twisted pairs 105 for enhanced cross talk performance under a wide range of operating conditions.

The flexible member 850 comprises a strip 860 running lengthwise (or longitudinally) along an interior or inner surface of the jacket 120. In an exemplary embodiment, the strip 860 can have a length of about 60 mils or more and a thickness of about 10 to 20 mils. In the illustrated exemplary embodiment, the strip 860 can be characterized as a ribbon of material or as a fin. Cable lay 125 typically works the strip 860 helically around the inner surface of the jacket 120 along the longitudinal length of the communication cable 800. Accordingly, the strip 160 corkscrews around the longitudinal axis 135 of the communication cable.

The strip 860 can, but not necessarily does, contact the jacket 120. In certain exemplary embodiments, a gap separates at least part of the strip 860 from the jacket 120. In certain exemplary embodiments, the strip 860 deforms or conforms to the interior of the jacket 120. Thus, while FIG. 8 illustrates the strip 860 protruding from the flexible member 800 at a substantially right angle, the angle may be acute due to deformation associated with cable fabrication.

The strip 860 can be constrained between the twisted pairs 105 and the jacket 120. Accordingly, the strip 860 can anchor the flexible member 850 to facilitate robust pair positioning.

The strip 860 joins with and projects from the strip 855, which can be a ribbon of material or a fin. In certain exemplary embodiments, the strips 155 and 160 are substantially perpendicular to one another at the joint 870. Alternatively, the strips 155 and 160 may be joined to form other angles, such as acute or obtuse. In an exemplary embodiment, the strip 855 protrudes about 140 mils or more from the strip 860 and has a thickness of about 10 to 20 mils. In certain embodiments, the strip 855 protrudes substantially less than 140 mils, for example about 50, 60, 70, 80, 90, 100, or 110 mils or in a range between any two of these dimensions, for example.

The joint 870 between the strips 855 and 860 is typically seamless as the flexible member 850 can be formed via extrusion through a die having an L-shaped opening that forms the illustrated cross section as molten material exits the die. However, the joint 870 can alternatively be formed using plastic welding, fusing, adhesives, bonding, or another appropriate joining technology known in the art. Accordingly, the flexible member 850 can be either formed as one unitary, seamless, and/or unbroken piece of material or assembled from multiple components.

The strip 855 can run along the longitudinal axis 135 of the communication cable 800. In certain exemplary embodiments, longitudinal axis 135 can be disposed substantially within the strip 855. Alternatively, the strip 855 can be disposed beside the longitudinal axis 135 or waver back-and-forth across the longitudinal axis 135.

In certain exemplary embodiments, the strip 855 divides the interior of the communication cable 800 substantially in half, with two of the twisted pairs 105 disposed on one side of the strip 855 and two of the twisted pairs 105 disposed on the other side of the strip 855. In certain exemplary embodiments, the strip 855 can divide the interior of the communication cable 100 into two interior spaces of differing size. Thus, with the embodiment that FIG. 8 illustrates as well with other disclosed embodiments, a feature of a pair positioning member can either extend substantially collinearly with the longitudinal axis 135 or be displaced from the longitudinal axis 135.

The edge 872 of the strip 855 projects laterally from the strip 860 and the joined edge 871, forming a point or a tip 875. Thus, the strip 855 can terminate laterally. However, in certain exemplary embodiments, this tip 875 is embedded or sunk into the jacket 120 or disposed in a groove of the jacket 120. The tip 875 can be rounded, square, sharp, dull, curved, angled, bent, or have some other appropriate geometric form or shape.

FIGS. 10, 11, 12, and 13 illustrate data from laboratory testing of a communication cable having four twisted pairs positioned by a T-shaped flexible member. The tested communication cable corresponds to the communication cable 100 illustrated in FIGS. 1 and 2 and discussed above and thus will be discussed below in that context.

Figure 10:
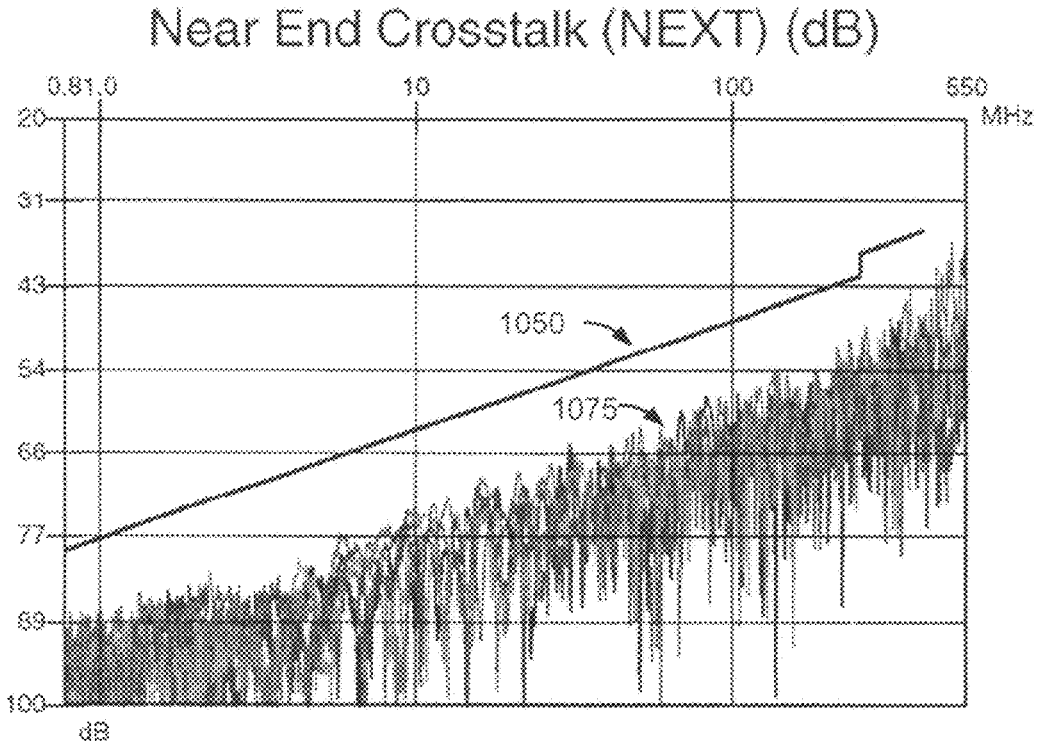
FIG. 10 is a chart of near end crosstalk for an exemplary communication cable that comprises a flexible member positioning twisted pairs in accordance with certain embodiments of the present invention.

Turning now to FIG. 10, this figure illustrates a chart 1000 of near end crosstalk ("NEXT") for a communication cable 100 that comprises a flexible member 150 positioning twisted pairs 105 according to certain exemplary embodiments of the present invention.

The plot 1050 represents minimum acceptable crosstalk performance across the indicated frequency range. The illustrated minimum adds a 3 dB margin to the industry minimum for Category 6 cables. Thus, the illustrated criterion is 3 dB more rigorous than industry standards require. The 3 dB margin is exemplary, and additional margin can be added.

The plots 1075 present measured cross talk among the twisted pairs 105. Thus, the plots 1075 show cross talk between twisted pair 1 and twisted pair 2, between twisted pair 1 and twisted pair 3, between twisted pair 1 and twisted pair 4, between twisted pair 2 and twisted pair 3, between twisted pair 2 and twisted pair 4, and between twisted pair 3 and twisted pair 4.

For each of the twisted pair combinations, the frequency column 1020 and the value column 1015 respectively present the frequency that produced the highest level of crosstalk and the measured value of that peak crosstalk. The worst case column 1010 presents the difference between the maximum measured crosstalk (the value column 1020) and the minimum acceptable crosstalk performance (the crosstalk criterion that the plot 1050 depicts). Since, as discussed above, the threshold for acceptance was set 3 dB more rigorous than the industry standard, the values in the worst case column are 3 dB more conservative than the industry standard. Accordingly, the test data presented in FIG. 10 show that the tested communication cable 100 performed 10.3 dB better than required by the Category 6 cable standard. (Crosstalk between twisted pair 2 and twisted pair 4 beat the acceptability threshold by 7.3 dB and thus the industry standard by 3 additional dB.)

Figure 11:
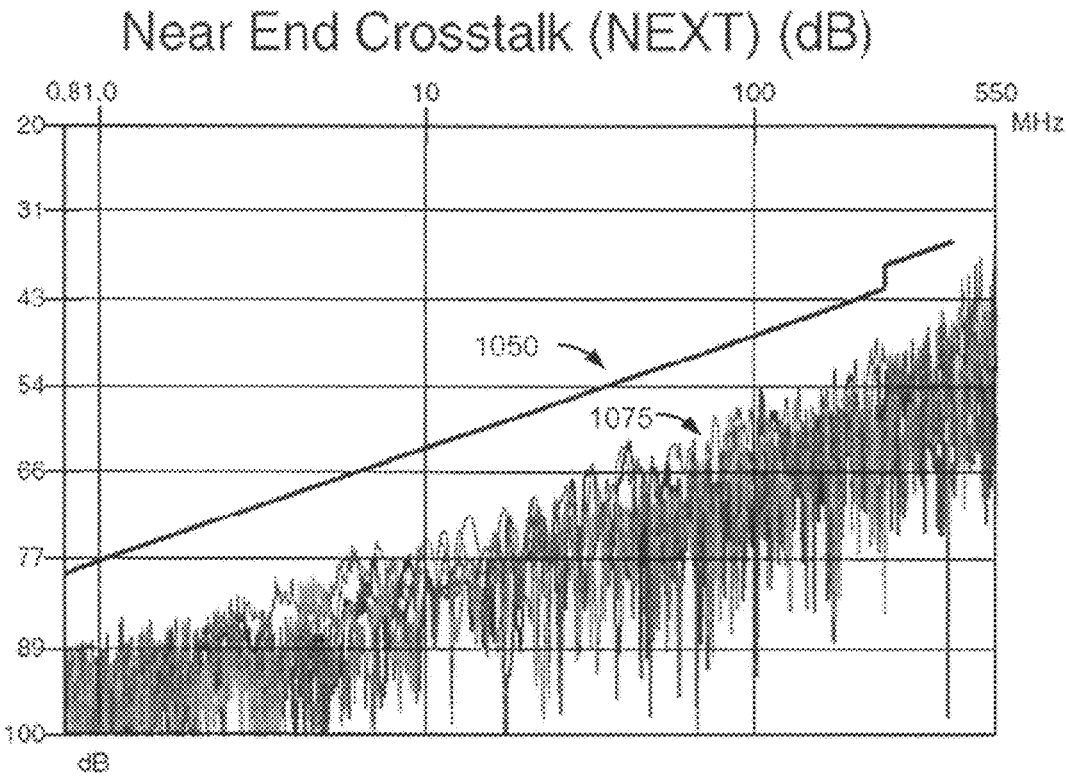
FIG. 11 is a chart of near end crosstalk for an exemplary communication cable that comprises a flexible member positioning twisted pairs in accordance with certain embodiments of the present invention.

Turning now to FIG. 11, this figure illustrates a chart 1100 of near end crosstalk for a communication cable 100 that comprises a flexible member 150 positioning twisted pairs 105 according to certain exemplary embodiments of the present invention. The chart 1100 has the same format and data presentation as the chart 1000 illustrated in FIG. 10 and discussed above.

The chart 1100 was generated by running a second test on the same communication cable 100 as tested in FIG. 10. However, for the test of FIG. 11, the direction of pair-to-pair signal testing was reversed ("REV"). For example, for the test of FIG. 10, crosstalk between twisted pair 1 and twisted pair 2 was evaluating by measuring the crosstalk that twisted pair 1 imposed on twisted pair 2. And for the test of FIG. 11, crosstalk between twisted pair 1 and twisted pair 2 was evaluated by measuring the crosstalk that twisted pair 2 imposed on twisted pair 1.

For the test of FIG. 11, the communication cable 100 outperformed the industry standard crosstalk requirement by 9.2 dB and the more rigorous criterion by 6.2 dB. (See worst case crosstalk between twisted pair 3 and twisted pair 4.)

Figure 12:
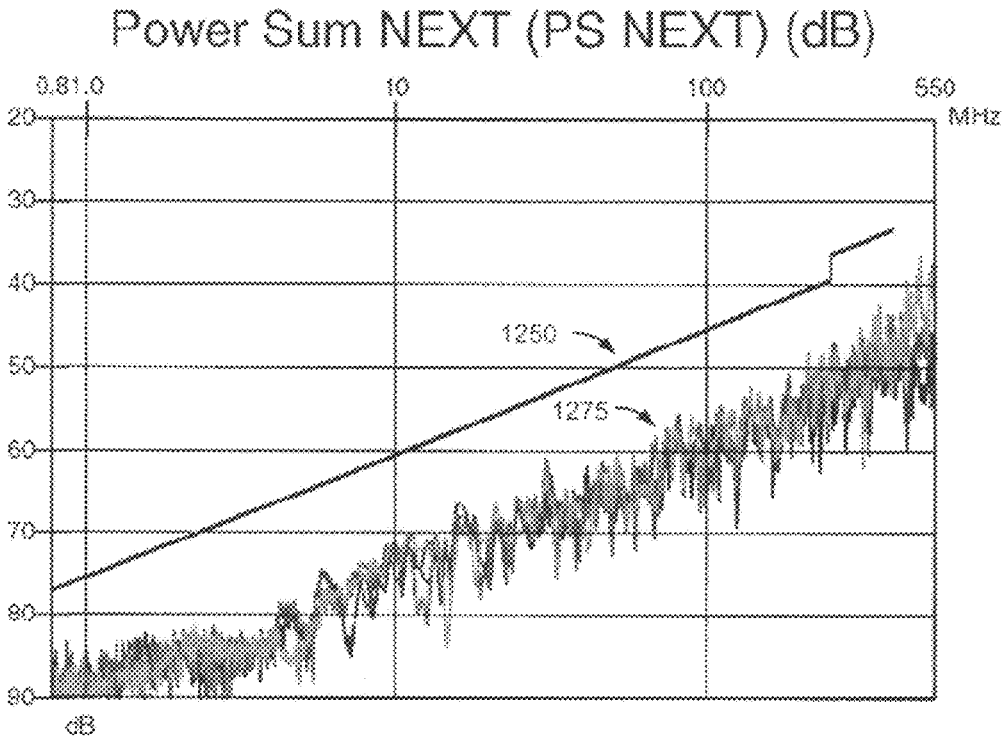
FIG. 12 is a chart of power sum near end crosstalk for an exemplary communication cable that comprises a flexible member positioning twisted pairs in accordance with certain embodiments of the present invention.
Figure 13:
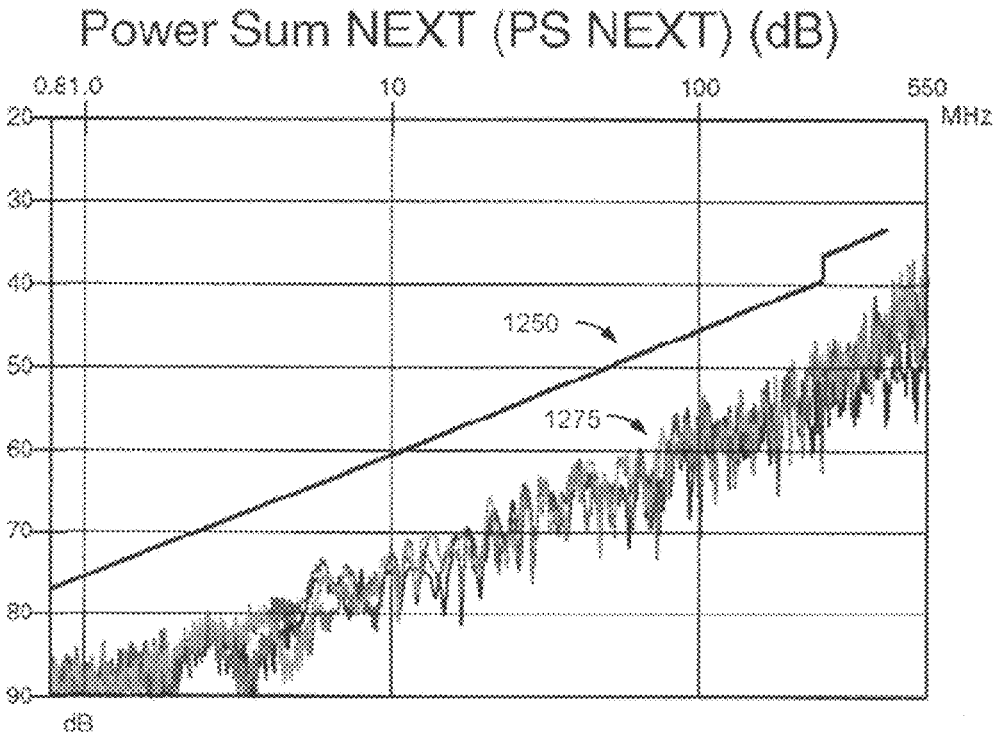
FIG. 13 is a chart of power sum near end crosstalk for an exemplary communication cable that comprises a flexible member positioning twisted pairs in accordance with certain embodiments of the present invention.

Turning now to FIGS. 12 and 13, FIG. 12 illustrates a chart 1200 of power sum near end crosstalk ("PS NEXT") for a communication cable 100 that comprises a flexible member 150 positioning twisted pairs 105 according to certain exemplary embodiments of the present invention. FIG. 13 likewise illustrates a chart 1300 of power sum near end crosstalk for a communication cable 100 that comprises a flexible member 150 positioning twisted pairs 105 according to certain exemplary embodiments of the present invention.

The power sum near end crosstalk data of FIGS. 12 and 13 were derived respectively from the near end crosstalk data that FIGS. 10 and 11 present. The data of FIGS. 10 and 11 was generated by measuring crosstalk on each twisted pair 105 as affected by the other three twisted pairs 105 individually. However, the data of FIGS. 12 and 13 was generated by adding the three near end crosstalk results for each twisted pair 105. For example, the power sum near end crosstalk for twisted pair 1 is a sum of the crosstalk on pair 1 due to twisted pair 2, twisted pair 3, and twisted pair 4.

Accordingly, power sum near end crosstalk represents the combined crosstalk effect that a twisted pair 105 would experience in a network deployment as a result of interaction with the communication cable's three other twisted pairs 105.

The data of FIGS. 12 and 13 represents laboratory testing on the same communication cable 100. As discussed above with reference to FIGS. 10 and 11, the direction of crosstalk induction is reverse for FIG. 13 relative to FIG. 12.

Each of the plots 1250 depicts the performance threshold for power sum near end crosstalk, again with a 3 dB margin of protection such that this threshold is 3 dB more rigorous than required by the industry standard. Each plot 1275 depicts measured power sum near end crosstalk for each of the four twisted pairs 105 (twisted pair 1, twisted pair 2, twisted pair 3, and twisted pair 4). The worst case column 1210, the value column 1215, and the frequency column 1220 of FIGS. 12 and 13 correspond respectively to the worst case column 1010, the value column 1015, and the frequency column 1020 of FIGS. 10 and 11.

The testing data of FIG. 12 shows a power sum near end crosstalk performance that is 6.8 dB better than the rigorous criterion and thus 9.8 dB better than the industry standard. For the reverse direction, the testing data of FIG. 13 shows a power sum near end crosstalk performance that is 6.9 dB better than the rigorous criterion and 9.9 dB better than the industry standard.

The charts 1000, 1100, 1200, and 1300 in combination with the foregoing discussion and figures describe how the present technology can support exemplary signal performance while providing benefits in enhanced robustness and reliability, improved manufacturability, and reduced material consumption leading to cost savings.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. A communication cable comprising:

four twisted pair of individually insulated electrical conductors extending lengthwise;

an outer jacket covering the four twisted pairs; and a flexible member extending lengthwise and spatially configuring the four twisted pairs, the flexible member comprising:

a first portion that forms two cavities within the outer jacket with two of the twisted pairs disposed in a first of the two cavities and the other two twisted pairs disposed in a second of the two cavities, wherein the differences between twist rates of twisted pairs that are circumferentially adjacent one another are greater than the differences between twist rates of twisted pairs that are diagonal from one another; and at least one second portion having a thickness that is substantially the same as that of the first strip, the at least one second portion joined to one end of the first portion and contacting the outer jacket, wherein the flexible member has a cross section having a T-shape, a Y-shape, an L-shape, or a J-shape.

2. The communication cable of claim 1, wherein the cross section has a T-shape.

3. The communication cable of claim 2, wherein the at least one second portion comprises a convex section that runs adjacent a surface of the outer jacket.

4. The communication cable of claim 2, wherein the at least one second portion comprises a section that conforms to an inner contour of the outer jacket.

5. The communication cable of claim 2, wherein the at least one second portion comprises a concave section.

6. The communication cable of claim 1, wherein the cross section has a Y-shape.

7. The communication cable of claim 1, wherein the cross section has an L-shape.

8. The communication cable of claim 1, wherein the at least one second strip anchors the flexible member to the outer jacket.

9. The communication cable of claim 1, wherein the flexible member comprises a plurality of electrically conductive patches that are electrically isolated from one another to provide one or more shields.

10. The communication cable of claim 1, wherein the communication cable comprises a substantially round cable.

11. A communication cable, comprising:

a jacket defining an interior space that extends lengthwise about a longitudinal axis of the communications cable;

a flexible member disposed in the interior space, extending lengthwise, and comprising:

a first fin running substantially along the longitudinal axis and substantially dividing the interior space into a first lateral space and a second lateral space, the first fin comprising a first edge extending lengthwise and a second edge extending lengthwise; and a second fin having a thickness that is substantially the same as the first fin, the second fin attached to the first edge of the first fin, wherein the first fin projects laterally from the second fin and the second edge forms a tip that extends lengthwise;

two twisted pairs of individually insulated electrical conductors disposed in the first lateral space; and two other twisted pairs of individually insulated electrical conductors disposed in the second lateral space.

12. The communication cable of claim 11, wherein the second fin is disposed substantially against an interior surface of the jacket, and wherein the first fin substantially bisects the interior space to provide the first lateral space and the second lateral space.

13. The communication cable of claim 11, wherein the second edge of the first fin runs along an interior surface of the jacket.

14. The communication cable of claim 11, wherein the second fin is concave or convex.

15. The communication cable of claim 11, wherein the first edge of the first fin is attached to an edge of the second fin.

16. The communication cable of claim 11, wherein the first edge of the first fin is seamlessly attached to the second fin along an approximate midpoint of the second fin.

17. The communication cable of claim 11, wherein the differences between twist rates of twisted pairs that are disposed circumferentially adjacent one another are greater than the differences between twist rates of twisted pairs that are diagonal from one another.

18. The communication cable of claim 11, wherein the flexible member comprises a plurality of electrically conductive patches that are electrically isolated from one another to provide one or more shields.

19. The communication cable of claim 11, wherein the communication cable comprises a substantially round cable.

20. A communication cable, comprising:

a jacket running longitudinally and defining an interior region;

a flexible member disposed in the interior region and comprising:

a first strip running longitudinally along an interior surface of the jacket and configured to anchor the flexible member to the jacket; and a second strip having a thickness that is substantially the same as the first strip and running longitudinally, joined with and projecting laterally from the first strip, forming a tip opposite the first strip, and separating the interior region into two chambers, with a plurality of twisted pairs of insulated signal conductors in each chamber.

21. The communication cable of claim 20, wherein the first strip is bowed toward the jacket.

22. The communication cable of claim 20, wherein the first strip is bowed away from the jacket.

23. The communication cable of claim 20, wherein the first strip and the second strip are seamlessly joined.

24. The communication cable of claim 20, wherein the first strip and the second strip are substantially perpendicular to one another in a cross section of the communication cable.

* * * * *